United States Patent [19]

Howard

[11] Patent Number: 4,686,491

[45] Date of Patent: Aug. 11, 1987

[54] DUAL PROBE SIGNAL RECEIVER

[75] Inventor: H. Taylor Howard, San Jose, Calif.

[73] Assignee: Chaparral Communications, San Jose, Calif.

[21] Appl. No.: 790,235

[22] Filed: Oct. 22, 1985

[51] Int. Cl.[4] ..... H01P 1/161; H01P 5/10

[52] U.S. Cl. ..... 333/21 A; 333/1; 333/26

[58] Field of Search ..... 333/1, 21 R, 21 A, 27, 333/24 R, 26, 100, 108, 135, 137, 230, 248, 251; 370/38, 123; 343/756, 786; 455/60, 63, 129, 280–282, 323–325, 327, 328

[56] References Cited

U.S. PATENT DOCUMENTS 2,362,561 11/1944 Katzin ..... 333/248 X 2,825,060 2/1958 Ruze ..... 343/786 X 4,414,516 11/1983 Howard ..... 333/21 A

*Primary Examiner*—Marvin L. Nussbaum

*Attorney, Agent, or Firm*—Lewis H. Eslinger

[57] ABSTRACT

A high-frequency signal receiver has two separate probes arranged within a waveguide for receiving both modes of an orthogonally polarized signal. A first probe protrudes directly into a rectangular cavity located at the receiving end of a circular waveguide and a second probe is specially shaped to employ the walls of the rectangular cavity and the circular waveguide as a ground plane, thereby to form a transmission line connected to a receiver probe portion arranged in the circular waveguide that receives the other of the orthogonal polarization not received by the first probe but which is reflected outwardly by the rectangular cavity.

11 Claims, 6 Drawing Figures

DUAL PROBE SIGNAL RECEIVER

BACKGROUND OF THE INVENTION

1. Field of the Invention

The present invention relates to high-frequency signal receivers and, more particularly, relates to a waveguide in which two probes are provided to increase receiving efficiency.

2. Description of the Background

Systems for receiving linearly polarized electromagnetic signals are well known and are now becoming increasingly important with the proliferation of satellite transmitted signals. An important feature of any such signal receiver is the shape and orientation of the receiver antenna probe, which typically is arranged within and near the closed end of a circular waveguide employed in the signal receiver. The signals received by such a waveguide and probe arrangement are fed to a low-noise amplifier (LNA) and then further processed in a conventional fashion. Frequently, provision is made to rotate the probe in the waveguide using a rotary drive mechanism to permit the probe to receive various individual polarizations of the incident signal. An example of a probe for use in such a rotating system is set forth in my U.S. Pat. No. 4,414,516 having a common assignee herewith. In that patent, the construction of the probe is specifically intended to optimize energy transfer by coupling the probe to the detected electromagnetic radiation at a location of lowest impedance in the waveguide.

A limitation of such a rotary probe signal receiver is that it can at one time pick up only one of the two orthogonally polarized modes of the typical satellite television signal. This means that only one half of the television channels available to the viewer may be processed at a time. This is undesirable where the number of viewers connected to the signal receiving system is high, e.g. with respect to a system for an apartment building. In addition, the motor for rotating the probe between the two polarized signal modes is subject to wear and tear and can be adversely affected by severe weather conditions.

There are numerous configurations of probes and waveguides having various dimensions and proportions, all intended to receive specific transmission frequencies and modes. Nevertheless, in view of the many different ways in which electromagnetic fields can be distributed within a waveguide, that is, the many different modes that are possible, and in view of the many different frequencies and polarization schemes that are proposed, there still remains the requirement to provide a waveguide pick-up for optimizing the reception of satellite transmissions, while minimizing cost and complexity.

OBJECTS AND SUMMARY OF THE INVENTION

Accordingly, it is an object of the present invention to provide a high-frequency signal receiver for receiving incident electromagnetic radiation that can eliminate the above-noted defects inherent in the prior art.

Another object of this invention is to provide a dual-probe signal receiver in which two probes are specially arranged and oriented in a waveguide to optimize reception efficiency.

It is another object of the present invention to provide a dual-probe signal receiver in which the two probes have different shapes and are arranged at different positions within a rectangular waveguide located at a receiving end of a circular waveguide, the circular waveguide having an injection end for receiving radiation.

In accordance with an aspect of the present invention, a first probe having a generally post-like construction is arranged to protrude straight into a substantially rectangular cavity formed at the receiving end of a circular waveguide and a specific hook-shaped probe is mounted near the location of the post-like probe but extends forwardly toward the open end, that is, the injection end of the circular waveguide. The hook-shaped probe utilizes the walls of the waveguide to form a single-wire transmission line over a ground plane. The transmission line is connected to a receiver probe portion that may be arranged substantially perpendicularly to the longitudinal axis of the circular waveguide at a low impedance location within the circular waveguide. The straight probe is employed to receive one polarization of two orthogonal mode signals as might be transmitted by a satellite and the hook-shaped probe is provided to receive the other polarization that is reflected from the back of the rectangular waveguide and which would otherwise be lost.

The above and other objects, features and advantageous of the present invention will become apparent from the following detailed description of illustrative embodiments thereof, to be read in conjunction with the accompanying drawings.

DETAILED DESCRIPTION OF THE PREFERRED EMBODIMENTS

Figure 1:
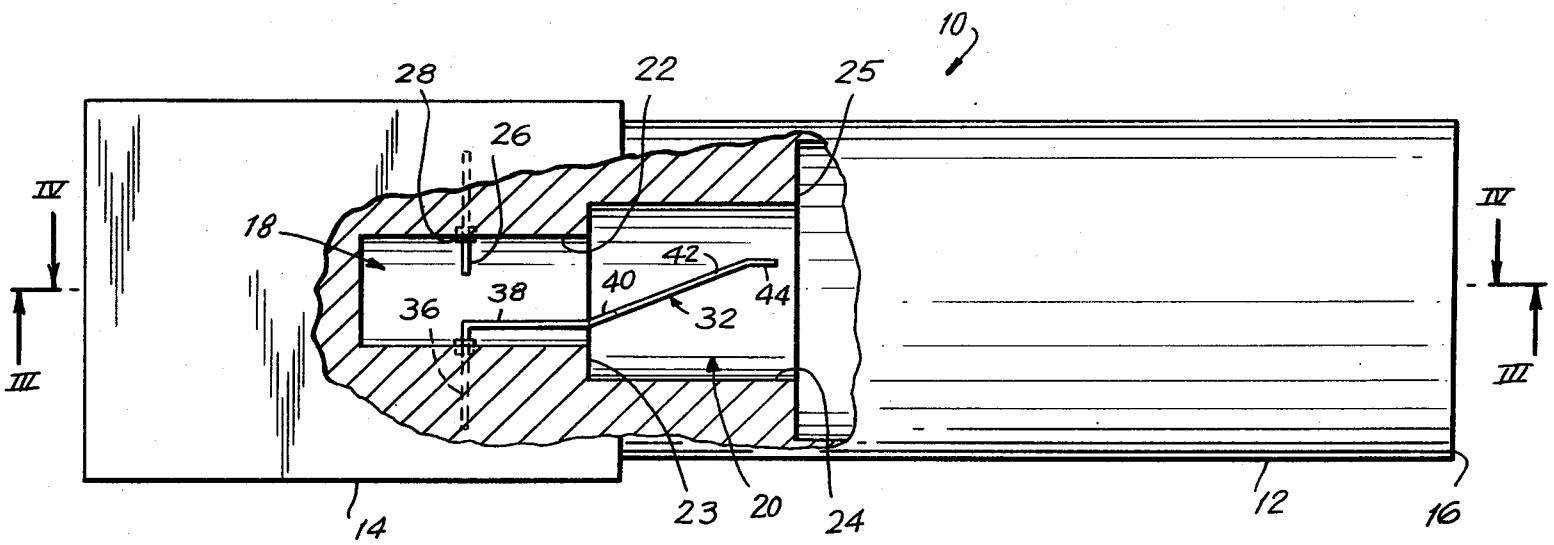
FIG. 1 is a side elevational view of a signal receiver having a portion of the waveguide wall cut away to show the dual probes arranged therein according to an embodiment of the present invention.

A signal receiver 10 is shown in FIG. 1 having a circular waveguide portion 12, which may be tubular in cross section, and which is attached to a base portion 14 which may be generally rectangular in cross section and which defines within it at least one substantially rectangular waveguide as described in detail below. A portion of the sidewall of the signal receiver 10 is cut away to show its interior. The electromagnetic radiation being received is injected at open end 16 of the circular waveguide 12 and typically such radiation may comprise television signals transmitted by an earth satellite in geosynchronous orbit. This circular waveguide 12 merely confines the energy of the electric and magnetic fields produced by the injected radiation that is propagated through the waveguide to the receiving end, located generally within the base portion 14.

Figure 2:
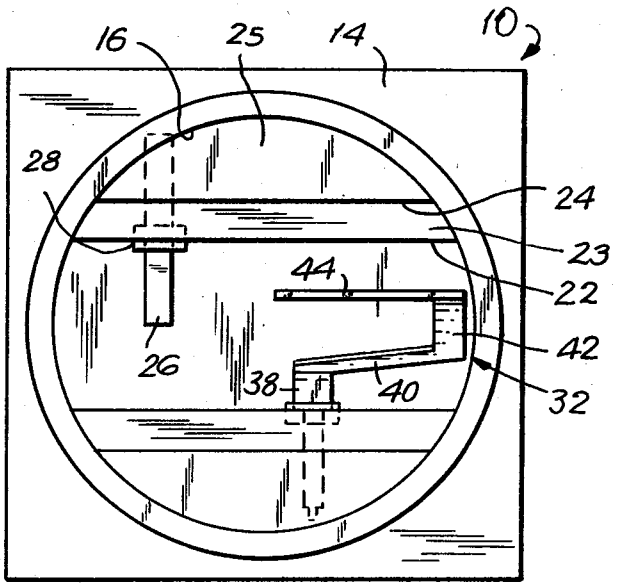
FIG. 2 is a front elevational view of the waveguide of FIG. 1.

There are at least two substantially rectangular interior waveguides formed as part of the signal receiving apparatus. At least one such waveguide 18 is formed within the base portion 14. A second rectangular waveguide 20 is formed at the receiving end of the circular waveguide 12 and is preferably substantially coaxial with and open to the waveguide 18. The waveguide 18 is formed with at least two opposed flat or straight sides or walls, shown typically at 22, and the waveguide 20 is formed with at least two opposed flat or straight sides or walls, shown typically at 24. Flat walls 22 and 24 are also seen in FIG. 2, which is an elevational view looking into the injection end of circular waveguide 12. In the preferred embodiment, the waveguides 20 and 18 are formed from inwardly stepped sidewall portions of the open interior of the signal receiver 10. From the size and arrangement of the walls 22 and 24 it is seen that the rearmost rectangular waveguide 18 is larger in cross section than the waveguide 20. This stepped arrangement defines substantially flat wall portions 23 and 25 (FIGS. 1 and 2) which face outwardly and lie in planes oriented substantially normal to the longitudinal axis of the circular waveguide 12.

Figure 3:
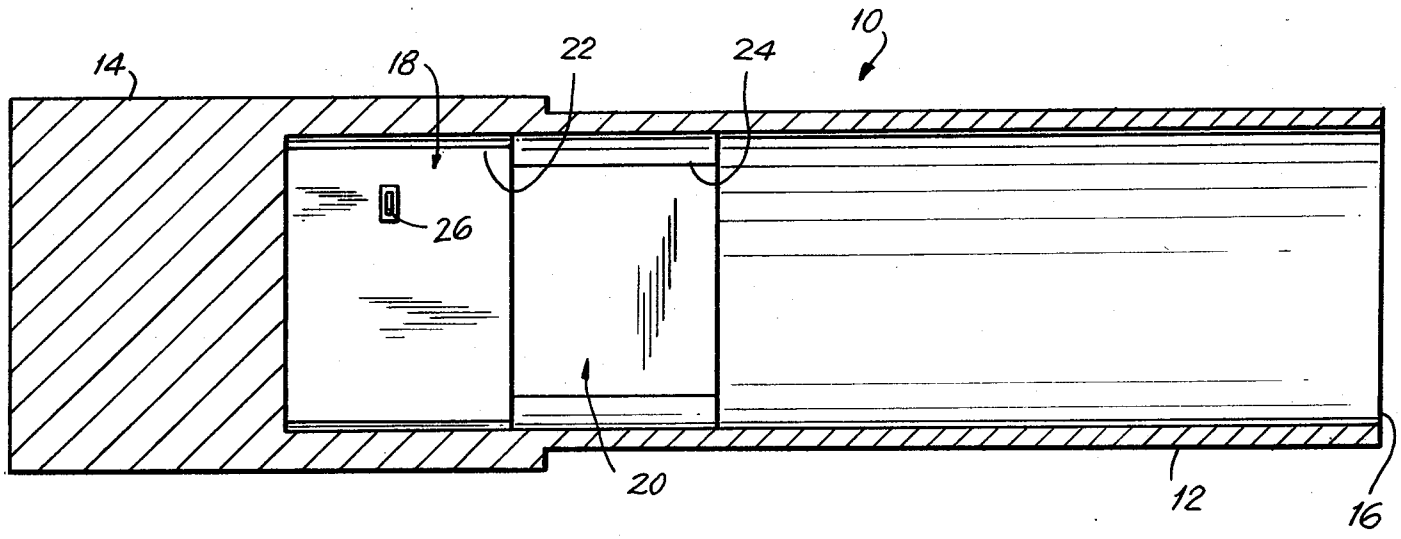
FIG. 3 is a cross-sectional view taken along section line III—III of the signal receiver of FIG. 1.

In the embodiment of FIGS. 1 and 2 an antenna probe 26 protrudes directly into the cavity which defines the waveguide 18. This probe is of a conventional post-like or generally flat configuration and the manner in which it is located is well known. The probe 26 can also have several shapes other than the shape shown, such as a cruciform, for example. This kind of probe is typically found in many of the presently available commercial waveguide pick-ups. A rear end of the probe 26 passes through a wall of the rectangular waveguide 18 by means of a dielectric feed-through 28, and is connected to a low noise amplifier in the conventional fashion. The preferred arrangement of probe 26 in the rectangular cavity 18 is also shown from the top in the cross-sectional view of FIG. 3.

This embodiment of the present invention provides a receiving system for use in receiving radiation transmitted from a satellite, in which there are two orthogonal modes $TE_{11}$ being injected at the end 16 of the circular waveguide 12. It is understood, of course, that the transverse electric mode (TE) describes the situation when the electric field is entirely transverse to the wave propagation direction but with a component of the magnetic field in the propagation direction, and further, it is understood that there are in general an infinite number of different ways in which the fields can arrange themselves in the waveguide. Such an infinite number of configurations assumes that there is no upper limit to the frequency of the transmission, with each field configuration being a so-called mode. With this in mind, it is then seen that the straight probe 26 picks up and directs to its low noise amplifier all of only one of the two fields. The other undetected one of the two orthogonal $TE_{11}$ fields will not be received by the probe 26 but will be reflected back out of the waveguide 12 into space. This second $TE_{11}$ mode, which is totally reflected back, is reflected because the rectangular waveguide 18 is oriented at right angles to that field, and since there is no direction for these waves to propagate they must suffer or undergo complete reflection. In satellite television this would typically mean the loss of 12 channels of television viewing.

Figure 4:
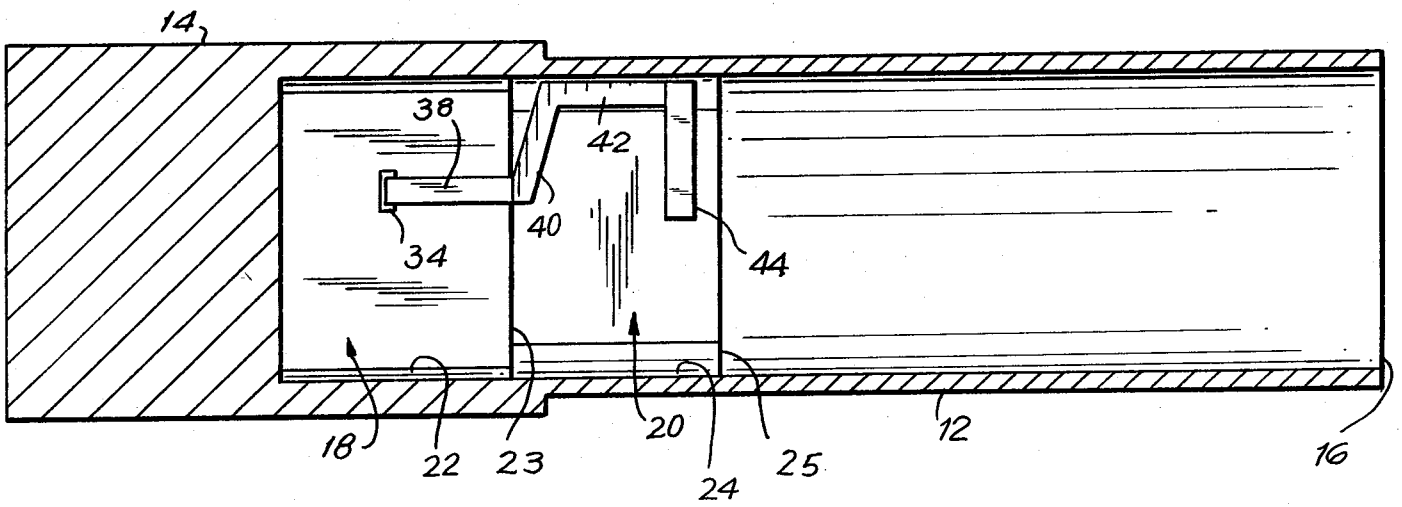
FIG. 4 is a cross-sectional view taken along section lines IV—IV of the signal receiver of FIG. 1.

To overcome this problem, the present invention provides a second antenna probe 32 having a number of characteristic features. More specifically, as shown in FIGS. 1, 2, and 4, the probe 32 enters the cavity forming the waveguide 18 through a dielectric feed-through 34. This probe thereafter extends generally toward the open end 16 of the waveguide and into the cavity forming the waveguide 20. At least a portion of the probe 32 is adapted to use the sidewall of the waveguides 18 and 20 as the ground plane of a single-wire low impedance transmission line. In one such embodiment, the probe 32 has a portion 38 which extends toward the open end 16 of the circular waveguide in a direction generally parallel to the flat sidewall 22 of the waveguide 18. The probe portion 38 may be spaced from and extend substantially parallel to the longitudinal axis of the circular waveguide 12. It is also preferably spaced from but proximate to the cavity wall 22.

Figure 5:
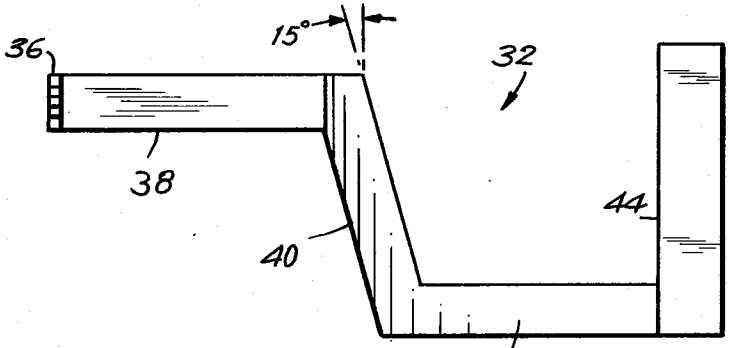
FIG. 5 is a side view of an embodiment of one of the probes used in the signal receiver of FIG. 1.
Figure 6:
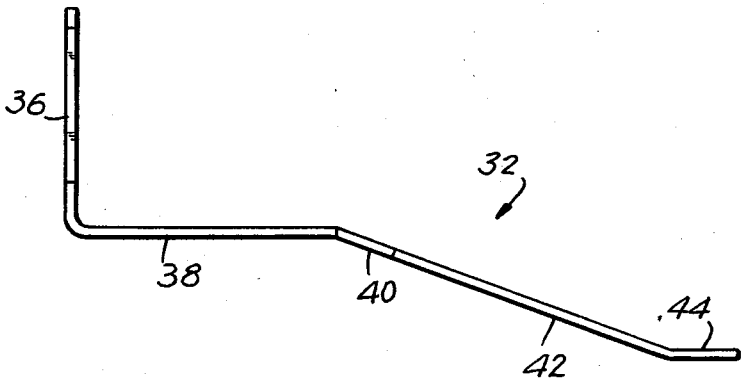
FIG. 6 is a top plan view of the probe of FIG. 5.

As shown more clearly in FIGS. 5 and 6, the probe 32 also has conductor portions 40 and 42 which together define a plane oriented generally obliquely to the cavity walls 22 and 24 and which extends toward the center of the circular waveguide 12. The portion 42 terminates at one end of a receiver probe portion 44.

The probe portion 40 projects toward the sidewall of the signal receiver 10 so as to position the portion 42 in a low impedance region of the circular waveguide. The portion 40 forms a transmission line section because the substantially rectangular cavity 20, although it appears to be an open circuit, is in fact a short circuit to the field of interest, that is, to one of the orthogonal $TE_{11}$ fields being received, and therefore becomes a so-called wall short circuit. Probe portions 40 and 42 can therefore be regarded as transmission line conductors.

The actual receiving probe portion 44 is connected at one end to the transmission line portion 42 and is preferably arranged to extend toward and to terminate in the vicinity of the longitudinal axis of the circular waveguide 12. The receiver probe 44 is arranged to be incident in the maximum signal field in the waveguide yet to be coupled to the transmission line portion 42 at the low impedance area of the circular waveguide relative to the incident radiation.

The two probes 26 and 32 can be formed of 0.025 inch thick beryllium copper sheet with the overall dimensions thereof being determined in part by the frequency of the received signal. In a typical case the overall dimensions of probe 32 might be 1.7 inches long by 0.75 inches wide.

Therefore, by use of the second specially formed probe 32, not only can that one of the two orthogonally polarized $TE_{11}$ fields which is typically reflected be received, but also such reception occurs in the optimum fashion by arranging the straight, receiving probe portion 44 to couple the reflected signal to the transmission line portion 42 at a location inside the waveguide corresponding to an area of low impedance.

The above description is provided for a single preferred embodiment of the invention, however, it will be apparent that many modifications and variations could be effected by one skilled in the art without departing from the spirit or scope of the novel concepts of the invention, which should be determined only by the appended claims.

What is claimed is:

1. A high-frequency signal receiver for receiving an orthogonally polarized, radiated signal, comprising:

a circular waveguide having an injection end with the radiated signal injected thereinto and having an oppositely located receiving end;

a rectangular cavity attached to said receiving end of said circular waveguide;

a first probe extending into said rectangular cavity and being substantially perpendicular to a longitudinal axis of said circular waveguide for receiving one polarization of said radiated signal; and a second probe arranged within said rectangular cavity at a side opposite said first probe for receiving the other polarization of said orthogonally polarized signal, said second probe being formed having a receiver probe portion arranged perpendicularly to said longitudinal axis, and being connected to a signal output through a transmission line formed by a conductor portion of said second probe and walls of said rectangular cavity and said circular waveguide that form a ground plane for said conductor portion, said receiver probe portion and said transmission line being connected together at an area of low impedance, relative to said radiated signal, within said circular waveguide.

2. A signal receiver according to claim 1, in which said first probe is formed as a flat, plate-like element.

3. A signal receiver according to claim 1, in which said second probe is formed as a hook-shaped element.

4. A signal receiver according to claim 3, in which said hook-shaped element includes a first conductor portion arranged parallel to said longitudinal axis and adjacent a wall of said rectangular cavity, a second conductor portion arranged perpendicular to said longitudinal axis adjacent a wall of said rectangular cavity, and conductor portion arranged parallel to said longitudinal axis adjacent a sidewall of said circular waveguide and being connected to an end of said receiver probe portion at a location adjacent said wall of said circular waveguide.

5. A signal receiver according to claim 3, in which said hook-shaped element is formed of a thin metal strip.

6. A signal receiver according to claim 3, in which said hook-shaped element is formed of copper.

7. A signal receiver for receiving orthogonally polarized signals, comprising:

a waveguide having an injection end for injecting the signals thereinto and an oppositely arranged receiving end;

a rectangular cavity attached to said receiving end of said waveguide;

a first probe protruding into said rectangular cavity for receiving one polarization of an orthogonally polarized signal; and a second probe extending into said rectangular cavity at a location opposite said first probe for receiving the other polarization of said orthogonally polarized signal, said second probe being formed having a receiver probe portion arranged perpendicularly to a longitudinal axis of said waveguide and located substantially at said receiving end of said waveguide and connected at one end to a signal output through a transmission line formed by a conductor of said second probe and a wall of said rectangular cavity that forms a ground plane for said conductor, said receive probe portion and said transmission line being mutually connected at an area of low impedance within said waveguide, relative to said orthogonally polarized signals.

8. A signal receiver according to claim 7, in which said second probe is formed as a hook-shaped element.

9. A signal receiver according to claim 8, in which said conductor of said second probe includes a first conductor portion arranged parallel to said longitudinal axis adjacent a wall of said rectangular cavity connected in series to a second conductor portion arranged perpendicular to said longitudinal axis and connected in series to a third conductor portion arranged parallel to said longitudinal axis adjacent a sidewall of said waveguide and being connected to said receiver probe portion at a location adjacent said wall of said waveguide.

10. A signal receiver according to claim 8, in which said hook-shaped element is formed of thin metal stock.

11. A signal receiver according to claim 8, in which said hook-shaped element is made of copper.

* * * * *